US012521612B2

(12) United States Patent
Llewellyn et al.

(10) Patent No.: US 12,521,612 B2
(45) Date of Patent: Jan. 13, 2026

(54) MODULAR PUTTER

(71) Applicant: Mizuno Corporation, Osaka (JP)

(72) Inventors: David Llewellyn, Norcross, GA (US); John Freeman, Norcross, GA (US); Kazuhiro Doi, Osaka (JP); Reiya Nishio, Osaka (JP)

(73) Assignee: Mizuno Corporation, Osaka (JP)

( * ) Notice: Subject to any disclaimer, the term of this patent is extended or adjusted under 35 U.S.C. 154(b) by 146 days.

(21) Appl. No.: 18/461,951

(22) Filed: Sep. 6, 2023

(65) Prior Publication Data

US 2025/0073547 A1 Mar. 6, 2025

(51) Int. Cl.

| | |
|---|---|
| ***A63B 53/06*** | (2015.01) |
| ***A63B 53/00*** | (2015.01) |
| ***A63B 53/04*** | (2015.01) |

(52) U.S. Cl.

CPC ..... *A63B 53/065* (2013.01); *A63B 53/007* (2013.01); *A63B 53/0433* (2020.08); *A63B 2053/0491* (2013.01)

(58) Field of Classification Search

CPC . A63B 53/065; A63B 53/0433; A63B 53/007; A63B 2053/0491; A63B 53/0487

USPC ..... 473/324–350, 287–292, 286, 313–314, 473/251

See application file for complete search history.

(56) References Cited

U.S. PATENT DOCUMENTS

| | | | | |
|---|---|---|---|---|
| 3,333,854 | A * | 8/1967 | White | A63B 53/0487 473/313 |
| 5,275,413 | A * | 1/1994 | Sprague | A63B 53/0487 473/337 |
| 5,597,362 | A | 1/1997 | Lee et al. | |
| 6,234,915 | B1 | 5/2001 | Wu | |
| 6,422,950 | B1 | 7/2002 | Whitlam | |
| 6,478,694 | B2 | 11/2002 | Anderson et al. | |
| 6,641,487 | B1 | 11/2003 | Hamburger | |
| 6,663,502 | B2 | 12/2003 | Nelson et al. | |
| 7,048,646 | B2 * | 5/2006 | Yamanaka | A63B 53/0487 473/340 |
| 7,147,569 | B2 | 12/2006 | Tang et al. | |
| 7,201,668 | B1 | 4/2007 | Pamias | |
| 7,452,283 | B2 | 11/2008 | Hettinger et al. | |
| 7,491,131 | B2 | 2/2009 | Vinton | |
| 7,677,987 | B2 | 3/2010 | Hilton | |
| 7,794,334 | B2 | 9/2010 | Hilton | |
| 7,828,675 | B2 | 11/2010 | Hilton | |
| 8,062,151 | B2 | 11/2011 | Boyd et al. | |

(Continued)

*Primary Examiner* — Sebastiano Passaniti
(74) *Attorney, Agent, or Firm* — TROUTMAN PEPPER LOCKE LLP; James E. Schutz; Korbin M. Blunck

(57) ABSTRACT

The disclosed systems and methods relate to improved customizable golf club heads. The golf club head can include a first body, a second body, and a fastener. The first body can include a striking face, a first top surface, a first bottom surface, a first heel, a first toe, a first rear wall opposite the striking face, and a hosel. The first body can further define at least one aperture. The second body can be removably attached to the first body. The second body can include a front face, a second top surface, a second bottom surface, a second heel, a second toe, and a second rear surface opposite the front face. The second body can define at least one second aperture. The fastener can extend through the at least one first aperture and into the at least one second aperture to attach the first and second bodies.

20 Claims, 12 Drawing Sheets

(56) References Cited

U.S. PATENT DOCUMENTS 8,876,623 B2 11/2014 Boyd et al.
9,108,092 B1 * 8/2015 Warner ..... A63B 53/06
9,132,325 B2 * 9/2015 Whitlam ..... A63B 60/00
9,144,717 B2 * 9/2015 Franklin ..... A63B 53/0487
9,446,291 B2 9/2016 Sanyal et al.
9,808,680 B1 11/2017 Myers et al.
9,956,463 B2 * 5/2018 Franklin ..... A63B 60/54
10,363,464 B2 * 7/2019 Cameron ..... A63B 53/007
11,173,360 B2 11/2021 Dolezel et al.
11,813,508 B2 * 11/2023 Higdon ..... A63B 53/0437
12,138,512 B2 * 11/2024 Andrews ..... A63B 60/54
2004/0132541 A1 7/2004 MacIlraith
2005/0159235 A1 7/2005 Gray
2005/0233828 A1 * 10/2005 Bonneau ..... A63B 53/0487 473/340
2007/0021230 A1 * 1/2007 Haack ..... A63B 60/02 473/340
2007/0243950 A1 * 10/2007 Billings ..... A63B 53/065 473/340
2008/0305885 A1 12/2008 Kinney
2013/0157774 A1 * 6/2013 Chen ..... A63B 53/0487 473/250
2013/0178307 A1 7/2013 Wicketts
2014/0106902 A1 * 4/2014 Whitlam ..... A63B 53/0487 473/340
2015/0258390 A1 9/2015 DeFrancesco, Jr.
2015/0335966 A1 * 11/2015 Cameron ..... A63B 53/0487 473/219
2015/0343285 A1 * 12/2015 Franklin ..... A63B 60/54 473/333
2022/0161108 A1 * 5/2022 Higdon ..... A63B 53/0437
2024/0165466 A1 * 5/2024 Parsons ..... A63B 60/02
2024/0293707 A1 * 9/2024 Parsons ..... A63B 53/0487
2025/0050180 A1 * 2/2025 Cameron ..... A63B 53/0441

* cited by examiner

MODULAR PUTTER

TECHNICAL FIELD

Aspects of the present disclosure relate to an improved golf club head, or portions thereof, configured for adjusting and customizing the golf club head, and, more particularly, to a modular putter.

BACKGROUND

The rules for the game of golf allow a player to bring up 14 clubs forming a set. Typically, a player fills their set with clubs of various types and models to provide the player with maximum options for the versatile situations he or she might encounter on the golf course. The most common groupings of clubs are the woods, the hybrids, the irons, the wedges, and the putter. The varying designs of the groups of clubs assist the player in launching the ball at different angles, heights, velocities, and distances. Some players buy all 14 clubs in a single combined set, while others buy their clubs bundled together by the grouping or even buy each club individually.

The putter tends to be the most unique club compared to the rest of a player's set. While the primary purpose for the woods, hybrids, irons, and wedges are to launch the ball into the air, the putter is designed to roll the ball along the ground, particularly on the putting green. While the putter is typically used to move the ball the shortest distance, it is often the most used club by a player throughout his or her round. A player tends to need to hit at least one putt on every hole, while on each individual hole he or she might not need to hit the particular distance or shape of shot that the other clubs promote.

Putters in the art come in a variety of shapes and sizes, and the best players in the world use various putter types. Ultimately the design of the putter must match the player to provide the most consistent roll of the golf ball when the player swings the putter. Certain designs promote greater or less loft when the putter is swung. Other designs provide higher levels of moment of inertia (MOI) when the putter is not struck in front of the center of mass. Further, some designs promote swings on a front to back plane, while other designs promote the putter to be swung along an arc. For some players, the most important feature for a putter design is how it fits their personal swing style or visual preferences to promote more confidence when putting.

With typical conventional putters, a player is limited to the particular putter shape, weight, and appearance he or she chooses. After a bad round of golf or upon a change in his or her swing, however, a player might find the particular design no longer optimizes his or her game. To remedy this situation players might purchase a brand-new putter or form a collection of putters from which they rotate between. Purchasing multiple putters can be expensive and maintaining a collection of putters can take up significant space due to the size of the shafts and grips attached to the putters. Stores and club fitters face similar inventory issues regarding putters. To offer a full range of putters covering the numerous combinations of size, shape, and weight, stores and club fitters must either dedicate significant space for inventory or limit their offerings. With limited offerings, stores and club fitters may be unable to offer for testing the precise characteristics a customer might require.

Other existing putters have attempted to remedy these issues by providing interchangeable weights or removable sections. Existing systems with interchangeable weights allow a player to optimize his or her putter in terms of total weight, however, this can create an undesirable limitation in controlling MOI or how the face moves when swung. As the interchangeable weights of the existing systems are designed to fit in the same place along the putters, the balance points and MOI of the putters will change as the varying weights are replaced for one another. For example, a blade-style putter with two 5 g weights in the middle of the sole will have a different balance point and MOI compared to the same blade style putter but with two 25 g weights in the middle of the sole.

Further, some existing putters include multiple interchangeable components that enable a configurable head construction. However, such systems tend to lack a stable constitution for the assembled putters. Thus, through extended use and impact, the separate pieces in these systems tend to loosen from each other. This can cause undesirable vibrations in these systems which can lead to inconsistent reactions when the systems are in use.

What is needed, therefore, is an adjustable golf club head, that allows a player to adjust the design and other features of the club head while still maintaining a stable and properly weighted head.

SUMMARY

The disclosed technology addresses these concerns as well as other needs that will become apparent upon reading the description below in conjunction with the drawings. Briefly described, aspects of the disclosed technology relate to an improved golf club head capable of adjustment with interchangeable pieces.

The disclosed technology can provide a putter-type golf club head including at least a first body, a second body, and a fastener. The first body can include a striking face, a first top surface, a first bottom surface, a first heel, a first toe, a first rear wall opposite the striking face, and a hosel. The first body can further be defined by at least one first aperture extending through the first body from the bottom surface. The second body can be removably attached to the first body. As an example, the second body can partially sit on the first body and/or a portion of the second body can be inserted into a portion of the first body. The second body can include a front face, a second top surface, a second bottom surface, a second heel, a second toe, and a second rear surface opposite the front face, the second body defining at least one second aperture extending into the second body, the front face extending upwardly at an angle relative to an axis passing through the at least one second aperture. The fastener can be configured to extend through the at least one first aperture and into the at least one second aperture to attach the first body to the second body.

Another aspect of the present invention can include a putter head that can include a first body, a second body, and a fastener. The first body can include a striking face, a rear wall opposite the striking face extending at an angle relative to a plane along the striking face, a ledge above the striking face, a bottom side of the ledge partially abutting the rear wall opposite the striking face, a first heel, a first toe, a first sole, a top side of the first sole partially abutting the rear wall opposite the striking face, and a hosel extending outwardly from the ledge. The second body can be removably attachable to the first body. As an example, the second body can partially contact the first body and/or a portion of the second body can be inserted into a portion of the first body. The second body can include a second sole, a top side of the second sole, a second heel, a second toe, a front face, and at least one mounting interface formed into the second sole, wherein the at least one mounting interfaces is configured to mount to at least a portion of the top side of the first sole. The fastener can be configured to attach the first body to the second body. As an example, the fastener can cause at least one force to the first body and the second body such that the first body and second body join. As another example the fastener can connect the first body and the second body.

Another aspect of the disclosed technology provides a putter head including a first body, a second body, a neck, and a fastener. The first body can include a striking face and a rear face, the rear face defining a channel. The neck can extend from a top face of the striking section. The second body can be removably attached to the first body. The second body can include a second sole section, a top side of the second sole section, and a front section attached to the second sole section and defining at least one recess, wherein the front section can contact the channel and the at least one recess of the front section is configured to align with the at least one aperture of the first sole. The fastener can extend through the at least one aperture and into the at least one recess to attach the first body to the second body.

A further aspect of the disclosed technology provides a method for customizing a putter head which can include aligning a first body with a second body, inserting the second body at least partially into a channel defined by the first body, at least a portion of a front surface of the second body configured to contact at least a portion of a rear surface of the first body, the rear surface of the first body extends upwardly at an angle relative to an axis extending through an aperture defined by a bottom surface of the second body, and fastening the first body to the second body with a fastener, the fastener can extend through the first body and into the second body.

BRIEF DESCRIPTION OF THE FIGURES

Reference now will be made to the accompanying figures, which are not necessarily drawn to scale, and wherein.

DETAILED DESCRIPTION

Figure 1A:
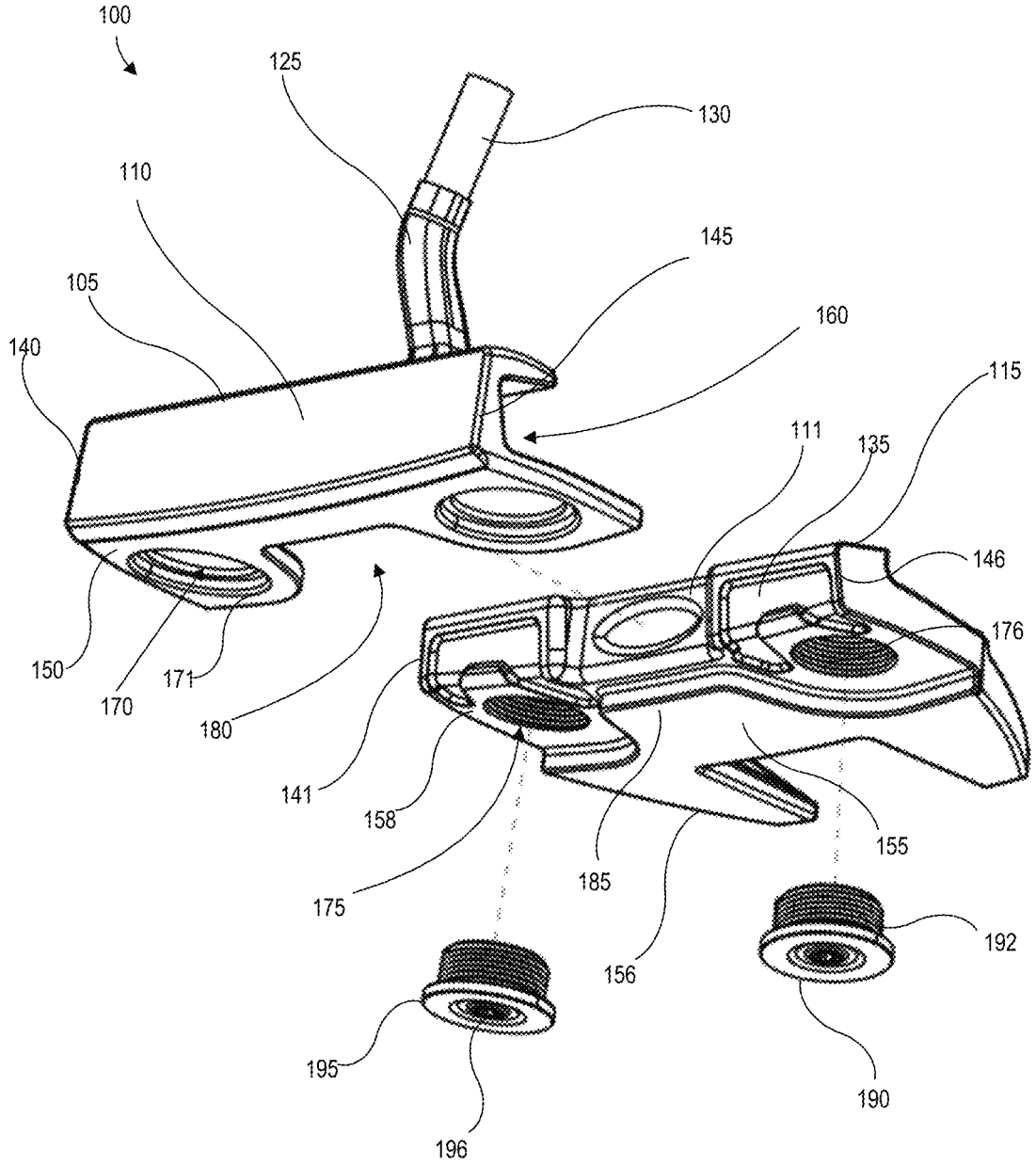
FIG. 1A is a partially exploded view of an example golf club head, according to the disclosed technology.

The disclosed technology includes a modular golf club head that can include removable elements that can adjust the golf club head characteristics including the weight and shape. The disclosed technology can include various interchangeable pieces that can be added or removed from the modular golf club head. The modular golf club head can provide flexibility and variety in the design compared to equivalents in the art. As an example, the golf club head can be for a putter-type golf club. The putter-type golf club head can have a short second body section removably attached to the first body section with two 20 g weighted screws, forming a heavy blade design. However, the 20 g weighted screws and the second body section could be removed and a different, longer second body section could be attached to the first body with 5 g weighted screws to form a lighter mallet design putter. As will become apparent throughout this disclosure, the modular golf club head can be configured for easy adjustability and can include several variations of configurations that can each promote different swing and visual characteristics for the golf club. Furthermore, the modular golf club head can include features that increase the stability of the golf club head in an assembled configuration when compared to existing technology. Additionally, the modular golf club head can increase efficiency over those in the art by utilizing weighted fasteners to allow for easy adjustment of the golf club head in both changes to weight as well as changes to arrangements of the interchangeable pieces.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being a modular putter. The present disclosure, however, is not so limited, and can be applicable in other contexts such other types of golf clubs (woods, hybrids, irons, wedges, etc.). Furthermore, the golf club head, as will be described herein, can be configured to include various putter designs such as a blade, a semi-mallet, wing mallet, or a mallet. Accordingly, when the present disclosure is described in the context of a modular putter head for pieces of a putter, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having." "has," "including." or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to and are not intended to imply that the objects so described must be in a given sequence, either temporally, spatially, in ranking, or in any other manner.

Also, in describing the various aspects of the disclosed technology, terminology will be resorted to for the sake of clarity. It is intended that each term contemplates its broadest meaning as understood by those skilled in the art and includes all technical equivalents that operate in a similar manner to accomplish a similar purpose.

Figure 1B:
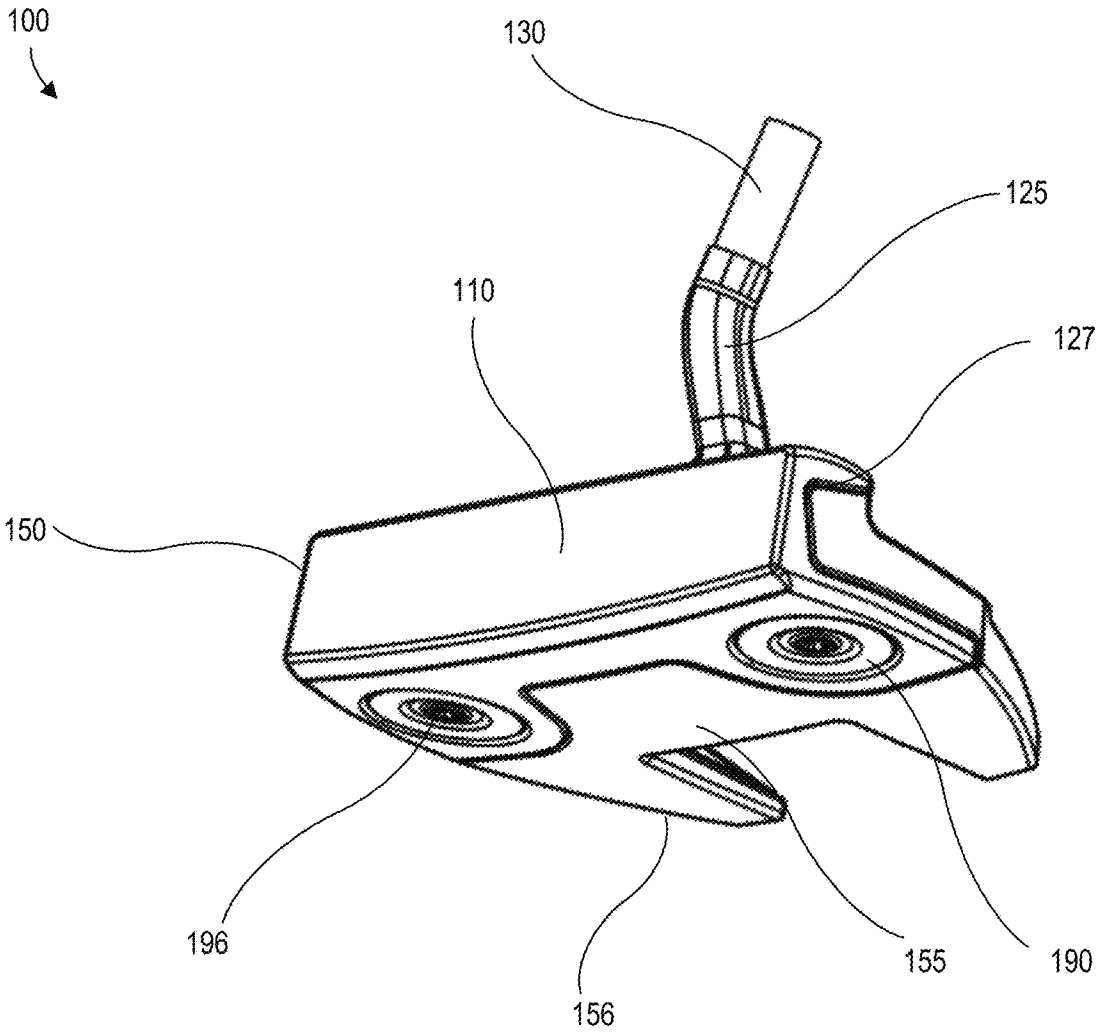
FIG. 1B is a perspective view of an example golf club head, according to the disclosed technology.

Various devices and methods are disclosed for providing and using a multi-pieced golf club, and examples of the devices and methods will now be described with reference to the accompanying figures. FIG. 1A is an exploded view of a golf club head 100 while FIG. 1B is an assembled view of the golf club head 100, according to the disclosed technology. As can be seen in FIG. 1A, a benefit of the present systems and methods is that the golf club head 100 can be readily assembled and disassembled to change the weight distribution and performance of the golf club head 100. The golf club head 100 can have four major components, although other examples can have greater or fewer parts (e.g. one, two, three, four, five, etc.). The four major components can include a first body 105, a second body 115 and one or more fasteners 190. The first body 105, a second body 115 and one or more fasteners 190 can be made from the same material (e.g. steel, aluminum, brass, copper, bronze titanium, carbon, zinc, etc.) or the first one can be made from first material (e.g. steel) and the second one can be made from a second material (e.g. aluminum).

The golf club head 100 can be a putter as shown in FIG. 1A, but it will be appreciated that the golf club head 100 is not so limited and can also be for an iron-, wedge-, hybrid-, or wood-type golf club head. As shown in FIG. 1B, the first body 105, a second body 115 and one or more fasteners 190 when assembled can form a mallet-style putter head. One feature of the disclosed technology, however, is that the golf club head 100 includes a modular design with the ability to switch any one or more of the golf club head 100 parts such that, when assembled, the combined parts form golf club heads 100 with varying characteristics. As an example, referring to FIGS. 4A-4C, any one of the components shown could be interchanged for another comparable component. Similarly, referring to FIGS. 5A-5C, any one of the components shown could be interchanged for another comparable component. Thus, between the six pieces shown in FIGS. 4A-4C and FIGS. 5A-5C, nine different configurations can be assembled. In this way, the multi-piece golf club head 100 can help to reduce the cost, space, and availability associated with owning a variety of styles of golf-club heads.

As shown in FIG. 1A, the golf club head 100 can include a first body 105, a second body 115 and one or more fasteners 190. The first body 105 can form a frontal section of the golf club head 100, while the second body 115 can form a rear section of the golf club head 100. As will be described in greater detail herein, when assembled, the first body 105 and the second body 115 can apply normal and shear forces upon each other to secure the first body 105 and the second body 115 to each other. In this way, the first body 105 and the second body 115 can form a stable golf club head 100.

The first body 105 can include a striking face 110, a first heel end 145, a first toe end 140, a ledge 127 defining a first top surface of the first body 105, a hosel 125, a first sole 150, at least one aperture 170 extending through the first sole 150, a recess, and a channel 160. For illustrative purposes, the golf club head 100 in FIG. 1 is shown as a putter-type golf club head. It will be appreciated, however, that an iron-, wedge-, hybrid-, or wood-type golf club head would be suitable for such a configuration.

The channel 160 can be formed opposite the striking face 110 such that the channel 160 forms at least three sides. A first side of the channel 160 can be defined by a bottom side of the ledge 127, a second side of the channel 160 can be defined by a rear wall 310 substantially opposite the striking face 110, and the third side of the channel 160 can be defined by a top surface 350 of the first sole 150, which can extend from the channel 160 to form a shelf. The channel 160 can extend from the first toe end 140 to the first heel end 145 and have an opening on each end. As will become apparent throughout this disclosure, the channel 160 can be configured to receive a portion of the second body 115. In this way, the channel 160 can help to hold the second body 115 in place when the golf club head 100 is in an assembled configuration.

The first sole 150 can be substantially flat or the first sole 150 can be arced or otherwise curved from the first toe end 140 to the first heel end 145 such that if a bottom surface of the first sole 150 rests on a flat surface, at least a portion of the bottom surface of the first sole 150 would not contact the flat surface. The first sole 150 can define a recess 180 between the first toc end 140 and the first heel end 145. The recess 180 can extend from a rear end of the first body 105 toward the striking face 110. As will become apparent throughout this disclosure, the recess 180 can be configured to receive at least a portion of the second body 115. Although shown as only a single recess 180, in some examples of the disclosed technology multiple recesses could extend from a rear end of the first body 105 toward the striking face 110. The rear wall 310 defining the second side of the channel 160 can be parallel to a plane along the striking face 110, while in other examples the rear wall 310 can be formed at an angle tangential or otherwise non-parallel to a plane along the striking face 110, creating a slanted appearance. The rear wall 310 defining the second side of the channel 160 can be perpendicular to the first and third sides of the channel 160 while in other examples the second side can form an acute with the first side defined by the bottom side of the ledge 127 and an obtuse angle with the third side defined by the top surface 350 of the first sole 150.

Figure 2:
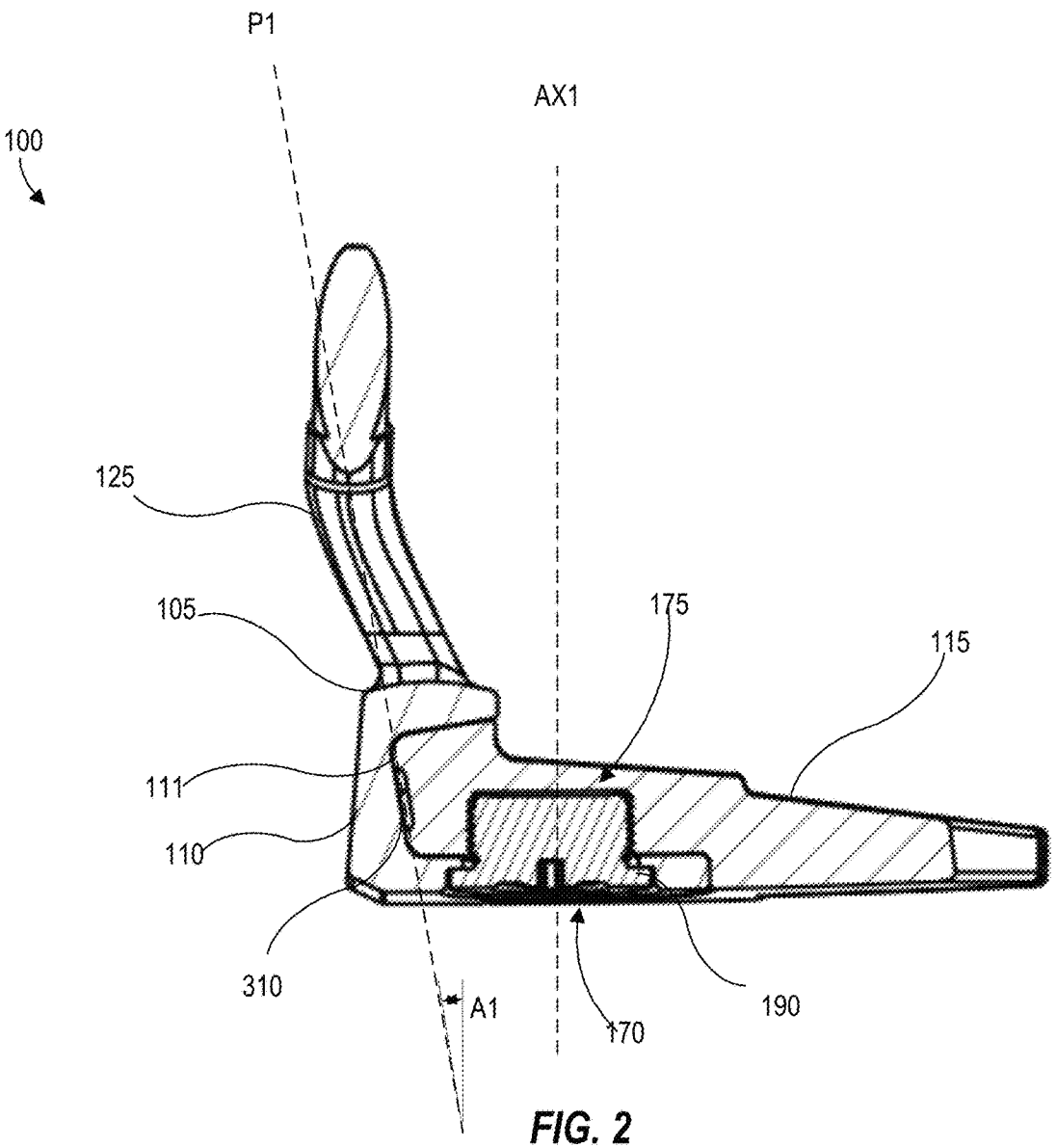
FIG. 2 is a cross-sectional view of an example golf club head, according to the disclosed technology.

As shown in FIG. 2, at least one aperture 170 can extend through the first sole 150 at an angle A1 neither perpendicular nor parallel to the rear wall 310 defining the second side of the channel 160. That is, an axis AX1 extending through the at least one aperture 170 can be non-parallel with a plane P1 defined by the rear wall 310. The angle A1, for example, can be approximately 10 degrees. In other examples, the angle A1 can be approximately 2 degrees, 5 degrees, 15 degrees, 20 degrees, 30 degrees, 45 degrees, 60 degrees, 75 degrees or another suitable angle generally between 1 and 89 degrees. In some examples, the angle A1 is between 2 and 45 degrees. As will be appreciated, the relationship between the angle A1 of the rear wall 310 and the aperture 170, can promote the first body 105, second body 115, and fasteners 190 to apply multiple directional forces upon each other, thereby securing the first body to the second body 115. As an example, the second body 115 could apply both a normal and shear force upon the first body 105 when the second body 115 is attached to the first body 105 via a fastener 190. As another example, the second body 115 could apply forces on the first body 105 in the direction parallel to the axis AX1 extending through the aperture 170 and in the direction perpendicular to the axis AX1 extending through the aperture 170. The at least one aperture 170 can include a lip 171 extending radially inward from the circumference of the at least one aperture 170. The lip 171 can be sized to prevent a portion of the fastener 190 from extending through the at least on aperture 170.

Referring back to FIG. 1A, the second body 115 of the golf club head 100 can include a front face 111, a second top surface 355, a second sole 155, a second heel 146, a second toe 141, a second rear surface 360 opposite the front face, at least one mounting interface 158, a protrusion 185, and at least one second aperture 175 extending into the second body 115. As will be appreciated, the second sole 155 can be substantially flat or the second sole 155 can be arced or otherwise curved from the second toe 141 to the second heel 146 such that if a bottom surface of the second sole 155 rests on a flat surface, at least a portion of the bottom surface of the second sole 155 would not contact the flat surface. The second sole 155 can include a protrusion 185 between the second toe 141 and the second heel 146 and extending toward the front face 111. Although shown as only a single protrusion 185, multiple protrusions could extend toward the front face 111. The bottom surface of second sole 155 can have at least one mounting interface 158 recessed therein, the at least one mounting interface 158 can be configured to receive at least a portion of the top surface 350 of the first sole 150. The at least one aperture 175 extending into the second body 115 can extend at an angle A1 that is neither perpendicular nor parallel to a plane P1 defined by the front face 111. In other words, an axis AX1 of the at least one aperture 175 extending into the second body 115 can be non-parallel to a plane P1 defined by the front face 111. The at least one aperture can include threading 176 spiraling along the circumference of the at least one aperture 175 and extending radially inward. As shown, the front face 111 can include at least one cavity 135. The second body 115 can further include a pair of wings 156 extending outwardly from the second rear surface 360.

The one or more fasteners 190 can be weighted screws (e.g., a screw having a Phillips head, a flat head, a Torx head, etc.), bolts, clips, and/or magnets. The one or more fasteners 190 can be inserted at least partially through the aperture 170 of the first body 105 and at least partially into the aperture 175 of the second body 115. As can be understood by one of skill in the art, extension of the at least one fastener 190 can apply a shear and a normal force between the first body 105 and the second body 115, due to the orientations of the apertures 170, 175 and the front face 111 and rear wall 310 as described herein. The fastener 190 can extend the full length of the apertures 170, 175, or the fastener can extend partially into the apertures 170, 175. The fastener 190 can be substantially cylindrical in shape. The diameter of the fastener 190 can be approximately 0.5 inches, 1 inch, 1.5 inches, 2 inches, or another suitable length generally between 0.2 and 3.5 inches. The height of the fastener 190 can be approximately 0.2 inches, 0.5 inches, 1 inch, 1.5 inches, 2 inches, or another suitable length generally between 0.1 and 3 inches. The fastener 190 can include threading 192 spiraling along the circumference of at least a portion of the fastener 190 and extending radially outward. The fastener 190 can include a shelf 195 extending radially outward from the fastener 190 and configured to contact the lip 171 of the first body 105. The diameter of the shelf 195 can be approximately 0.5 inches, 1 inch, 1.5 inches, 2 inches, or another suitable length generally between 0.25 and 3.5 inches. The fastener 190 can include a keyhole 196 configured to receive a screwdriver or other fastening device. The keyhole 196 can include a variety of shapes, e.g. a cross, a star, a Torx receiver etc.

The fastener 190 can be selected in various weights generally between 2 and 50 grams, e.g. 5 g, 10 g, 15 g, 20 g, 30 g, 40 g, 45 g. The fastener 190 can be a continuous piece of material, or can include hollowed portions. The fasteners 190 can be made from various material (e.g. steel, aluminum, brass, copper, bronze titanium, carbon, zinc, etc.). Therefore, two fasteners 190 of the same weight, e.g. 10 g, can have differing weight distributions and/or differing sizes depending on material and composition. As will be appreciated, different fastener weights, heights, and weight distributions, can affect the balance points of an assembled golf club head 100 and, therefore, affect the performance of the golf club head 100.

Although shown and described herein as a golf club head 100 formed by a first body 105 and second body 115, it will be appreciated that additional bodies can be attached to form the golf club head 100. For example, the wings 156 can be removably attachable to the second body 115 in some examples. Similarly, the second body 115 can be separated into a second toe 141 side section and second heel 146 side section. Further, each additional body section can define an aperture through which a fastener 190 can extend.

FIG. 2 shows an assembled configuration of the exemplary golf club head of FIG. 1. The assembled golf club head 100 can have the various parts connected to form a single continuous shape. The mounted interface 158 of the second body 115 can sit upon the top surface 350 of the first sole 150, such that the bottom surface of the first sole 150 can be continuous with the bottom surface of the second sole 155. The apertures 170 of the first body 105 can align with the apertures 175 of the second body 115 such that the fastener 190 can extend through the apertures 170, 175 such that a surface of the shelf 195 of the fastener 190 can be continuous with the bottom surface of the first sole 150. In the assembled configuration, the protrusion 185 of the second sole 155 can extend flush into the recess 180 of the first sole 150. In the assembled configuration, the front face 111 of the second body 115 can abut the rear wall 310 forming the second side of the channel 160 of the first body 105. A portion of the top surface 355 of the second body 115 can at least partially abut the bottom surface of a ledge 127 of the first body 105.

Figure 3A:
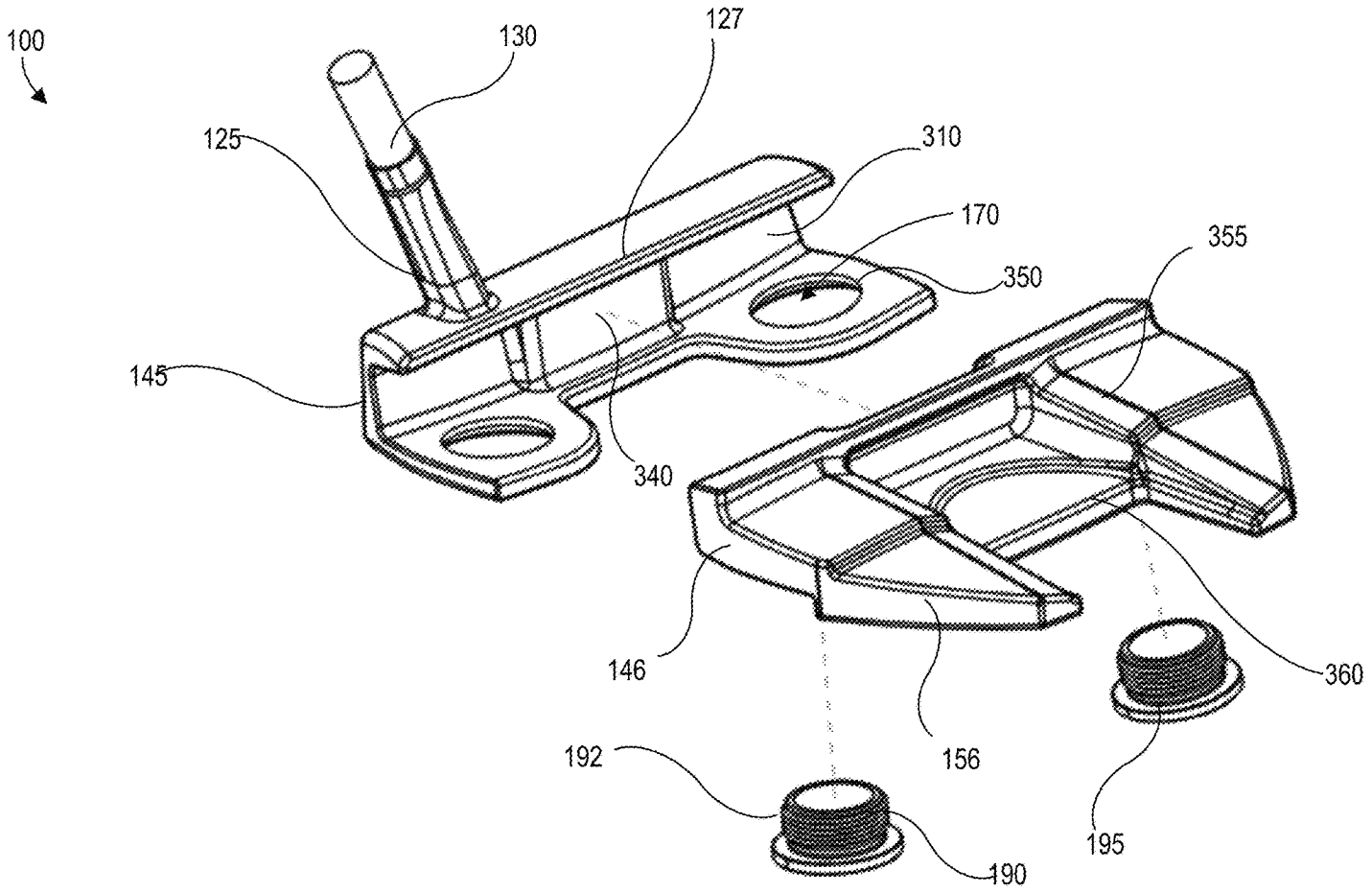
FIG. 3A is a partially exploded view of an example golf club head, according to the disclosed technology.
Figure 3C:
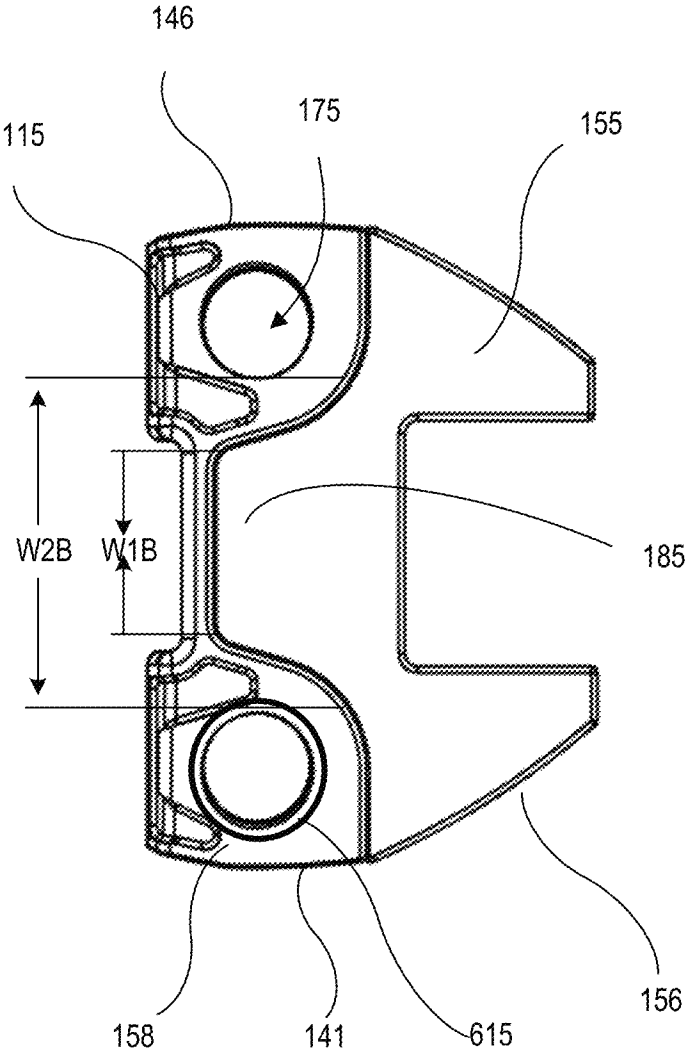
FIG. 3C is a bottom view of an example body section of a golf club head, according to the disclosed technology.
Figure 3B:
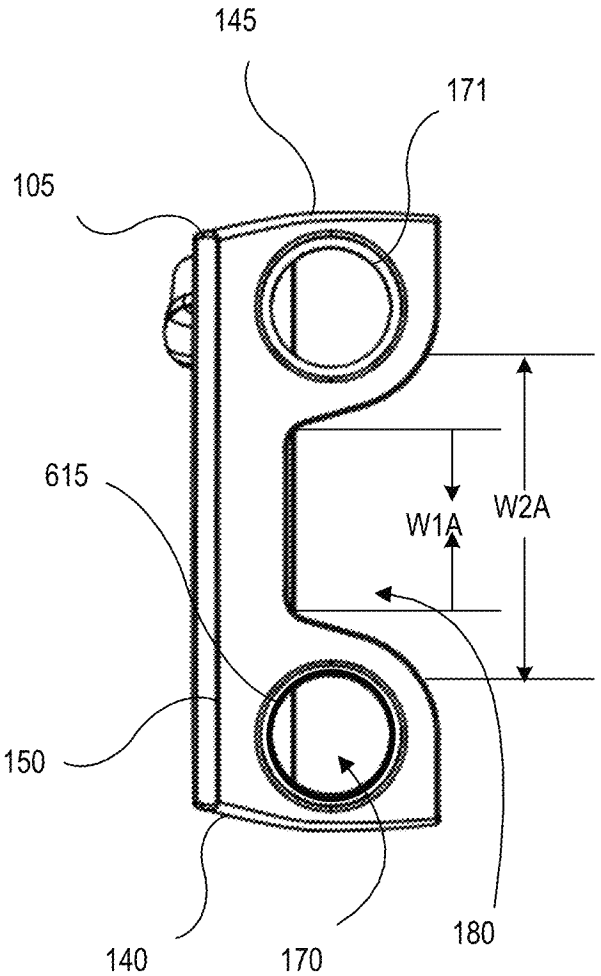
FIG. 3B is a bottom view of an example body section of a golf club head, according to the disclosed technology.
Figure 3D:
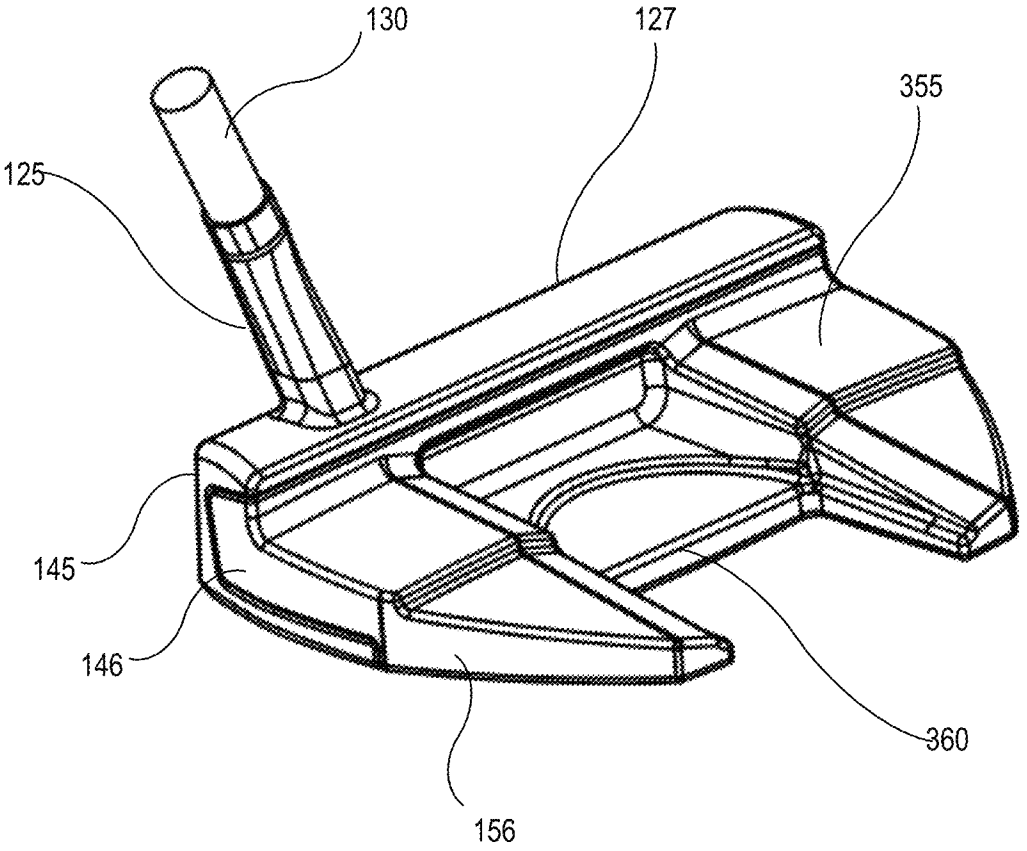
FIG. 3D is a rear perspective view of an example golf club head, according to the disclosed technology
Figure 6A:
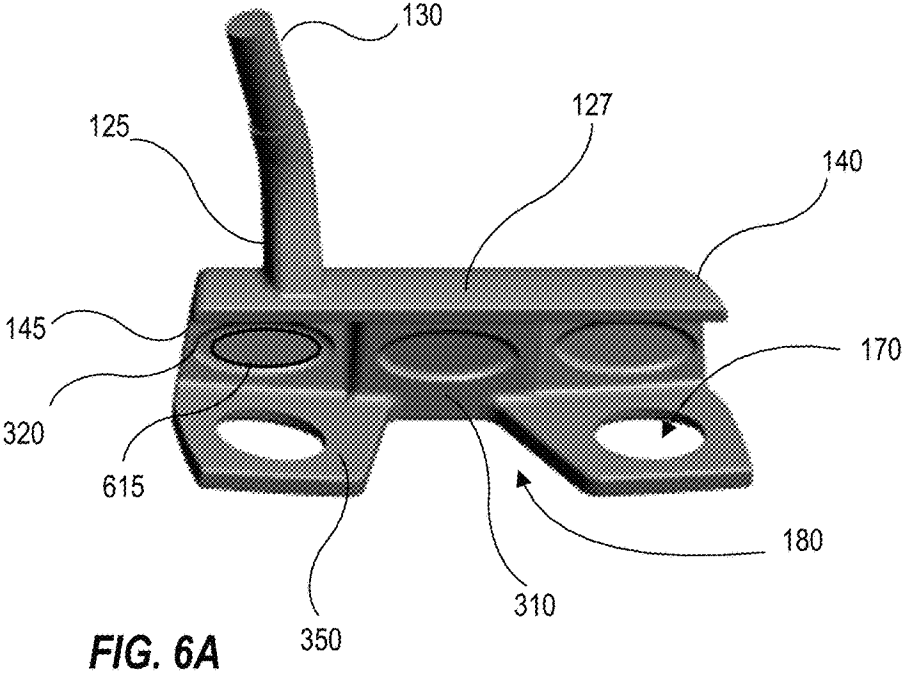
FIG. 6A is a perspective view of an example body section of a golf club head, according to the disclosed technology.

FIG. 3A shows a second exploded view of the exemplary of a golf club head 100 of FIG. 1A, while FIG. 3D shows an assembled view of the exemplary golf club head 100 of FIG. 3A. As shown in FIG. 3A, the rear wall 310 forming the second side of the channel 160 of the first body 105 can include a protruding section 340 between the first heel 145 and the first toc 140 and extending outwardly in the direction opposite the striking face 110. In some embodiments, such as shown in FIG. 6A, the rear wall 310 can also include at least one cavity 320. A rubber sheet 625 or an o-ring 615 can be disposed within the at least one cavity, and the rubber sheet 625 can similarly extend to be disposed between at least a portion of the top surface 350 of the first sole and at least one mounting interface 158 recessed in the second sole 155. The rubber sheet(s) 625 or o-ring(s) 615 can provide for absorption of impact forces between the first body 105 and the second body 115 and help to ensure sufficient frictional forces are present between the first body 105 and the second body 115 to secure the first body 105 to the second body 115. Referring back to FIG. 3A, the recess 180 can substantially align with the protruding section 340 of the rear wall 310. As shown, the hosel 125 can extend outward from the ledge 127 of the first body 105. The hosel 125 can allow for insertion or attachment of a shaft 130. The shaft 130 can be made of various materials including steel, graphite, and combinations thereof. The hosel 125 extend from multiple regions of the ledge 127, including a region near the heel 145 or near the center of the ledge 127. The placement for extension of the hosel 125 can affect the rotation of the golf club head relative to movement of the hosel 125 and shaft 130. An alignment aid 370 (such as that shown in FIG. 4B) can be defined in the top surface 355 of the second body 115. The alignment aid 370 can be a line perpendicular to a plane formed by the front face 111 and can extend to proximate a rear surface of the second body 360. The alignment aid 370 can also be a dot, circle, semi-circle, or series of lines. As can be appreciated by one in the art, the alignment aid 370 can assist a user in directing the golf club head 100 relative to a golf ball.

FIG. 3B shows a bottom view of the first body 105 of a golf club head 100. As shown, the first sole 150 can extend from a first toe end 140 to a first heel end 145. The first sole 150 can define a recess 180 between the first toe end 140 and the first heel end 145. The recess 180 can extend from a rear end of the first body 105 toward the striking face 110 with a variable width. The recess 180 can have a first end proximate the striking face 110 having a first width W1A and a second end proximate the rear end of the first sole 150 having a second width W2A. The width W1A of the recess 180 at the first end can be less than the width W2A of the recess 180 at the second end. The recess 180 can be configured to receive at least a portion of the second body 115. Although shown as only a single recess 180, multiple recesses can extend from a rear end of the first body 105 toward the striking face 110. Additionally, as shown, the first sole 150 can define at least one aperture 170. The at least one aperture 170 can include a lip 171 extending radially inward from the circumference of the at least one aperture 170. The lip 171 can be sized to prevent a portion of the fastener 190 from extending through the at least one aperture 170. An O-ring 615 can be disposed inside the at least one aperture 170 and on the lip 171. The O-ring(s) 615 can provide for absorption of impact forces between the first body 105 and the fastener 190 and help to ensure sufficient frictional forces are present between the first body 105 and the fastener 190 to secure the first body 105 to the fastener 190.

FIG. 3C shows a bottom view of the exemplary of second body 115 of a golf club head 100. As shown, the second sole 155 can extend from a second toe end 141 to a second heel end 146. The second sole 155 include a protrusion 185 between the second toe 141 and the second heel 146 and extending toward the front face 111. The protrusion 185 can have a first end proximate the front face 111 having a first width W1B and a second end distal the front face 111 having a second width W2B. The width W2B of the protrusion 185 at the second end can be greater than the width W1B of the protrusion 185 at the first end. Although shown as only a single protrusion 185, multiple protrusions could extend toward the front face 111. The bottom surface of second sole 155 can have at least one mounting interface 158 recessed therein, the at least one mounting interface 158 can be configured to receive at least a portion of the top surface 350 of the first sole 150. The second body 115 can define at least one aperture 175 extending thereinto. An O-ring 615 can be disposed on the at least one mounting interface 158 and around the at least one aperture 175 extending thereinto. The O-ring(s) 615 can provide for absorption of impact forces between the first body 105 and the second body 115 and help to ensure sufficient frictional forces are present between the first body 105 and the second body 115 to secure the first body 105 to the second body 115.

As illustrated in FIGS. 4A-F the second body 115A, 115B, 115C can be formed in a variety of shapes. As can be appreciated by one in the art, the varying shapes promote different characteristics for the user as well as offer different visual perspectives. In comparison of the three examples shown, the front face 111, top shelf 346 of the second body 115, and length from the second heel 146 to second toe 141 of the three example bodies remain approximately identical. As will be appreciated, by keeping the characteristics of portions of the second body 115 that abut portions of the first body 105 consistent between differing examples, the second bodies 115A, 115B, 115C can each be assembled with the same first body 105. As is shown in FIGS. 4A-F, the characteristics of the portions of the second body 115 not abutting the first body 105 can differ to create varying shapes of golf club heads 100 when in an assembled configuration. As can be appreciated, the differing shapes can alter characteristics of the assembled golf club head 100 such as the moment of inertia ("MOI").

Figures 4A, 4B, 4C:
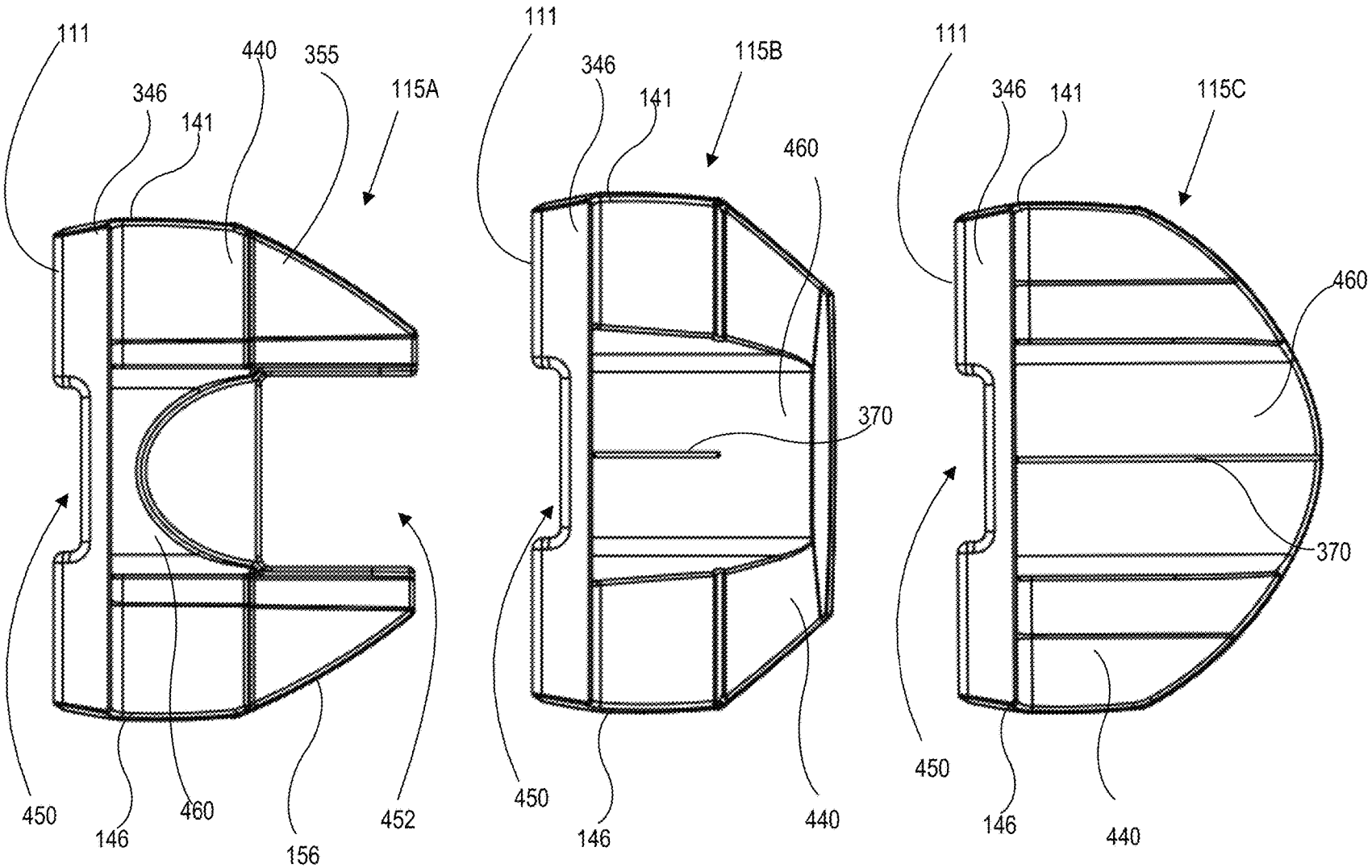
FIG. 4A is a top view of an example body section of a golf club head, according to the disclosed technology.
FIG. 4B is a top view of an example body section of a golf club head, according to the disclosed technology.
FIG. 4C is a top view of an example body section of a golf club head, according to the disclosed technology.

Referring to FIG. 4A, a top view a second body 115A with a mallet shape can be formed to include a pair of wings 156 that can extend outwardly from the rear surface 360. A recess 452 can be defined between the pair of wings 156 and the remainder of the rear surface 360. The remainder of the rear surface 360 can be substantially parallel to a plane along the front face 111. The front face 111 can define a recess in the center between the second toe 141 and the second heel 146. The top surface 355 of the second body 115A can include a lower section 460 closer to the bottom surface of the second sole 155 and at least one upper section 440 closer to the top shelf 346.

Referring to FIG. 4B, a top view a second body 115B with a flat, semi-mallet shape can be seen. The front face 111 can define a recess 450 in the center between the second toe 141 and the second heel 146. The top surface 355 of the second body 115B can include a lower section 460 proximate to the bottom surface of the second sole 155 and at least one upper section 440 proximate to the top shelf 346. The at least one upper section 440 can define an alignment aid 370 in a direction perpendicular to a plane along the front face 111. The rear surface 360 can be substantially parallel to a plane along the front face 111.

Referring to FIG. 4C, a top view of a second body 115C with a semi-round, semi-mallet shape can be seen. The front face 111 can define a recess 450 in the center between the second toe 141 and the second heel 146. The top surface 355 of the second body 115C can include a lower section 460 proximate to the bottom surface of the second sole 155 and at least one upper section 440 proximate to the top shelf 346. The at least one upper section 440 can define an alignment aid 370 in a direction perpendicular to a plane along the front face 111. The rear surface 360 can form a horizontal arc with an apex of the arc extending in a direction opposite the front face 111.

Figure 4F:
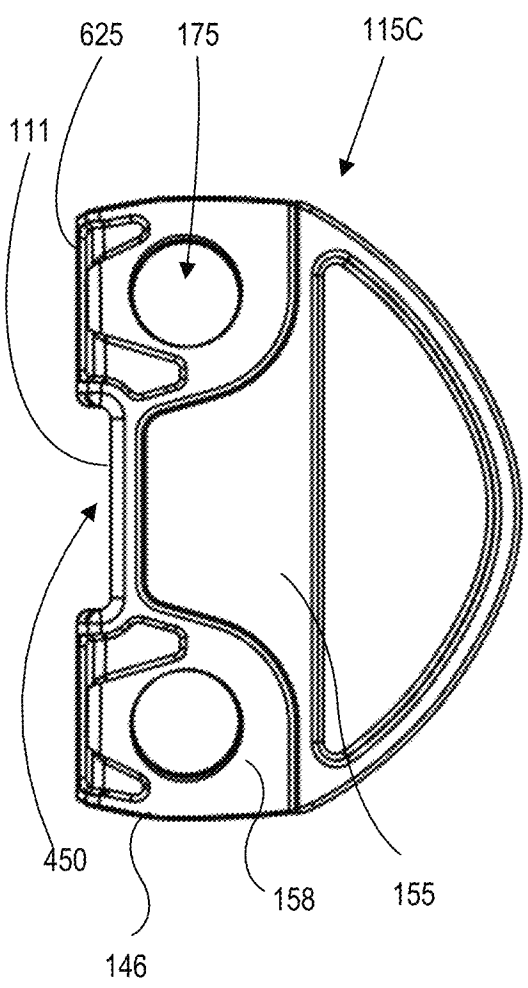
FIG. 4F is a bottom view of an example body section of a golf club head, according to the disclosed technology.
Figure 4E:
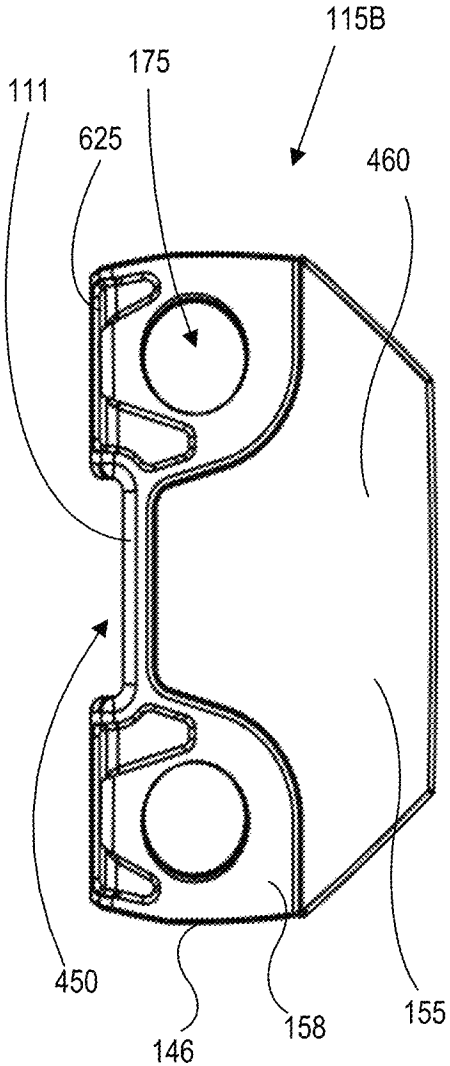
FIG. 4E is a bottom view of an example body section of a golf club head, according to the disclosed technology.
Figure 4D:
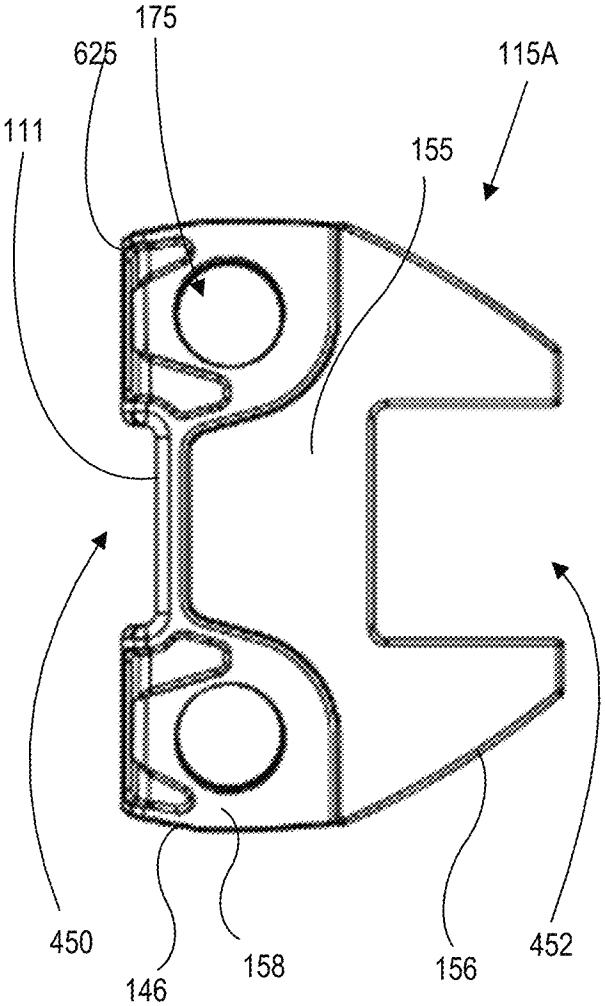
FIG. 4D is a bottom view of an example body section of a golf club head, according to the disclosed technology.

Referring to FIG. 4D which a bottom view of the second body 115A having a mallet shape. The second body 115A can be formed to include a pair of wings 156 that can extend outwardly from the rear surface 360. A recess 452 can be defined between the pair of wings 156 and the remainder of the rear surface 360. The remainder of the rear surface 360 can be substantially parallel to a plane along the front face 111. The front face 111 can define a recess 450 in the center between the second toe 141 and the second heel 146. The front face 111 can include rubber sheets 625 disposed thereon. The bottom surface of second sole 155 can have at least one mounting interface 158 recessed therein. At least one aperture 175 can be defined extending at least partially into the second body 115A from the at least one mounting interface 158.

Referring to FIG. 4E, a bottom view a second body 115B with a flat, semi-mallet shape can be seen. The rear surface 360 can be substantially parallel to a plane along the front face 111. The front face 111 can define a recess 450 in the center between the second toe 141 and the second heel 146. The front face 111 can include rubber sheets 625 disposed thereon. The bottom surface of second sole 155 can have at least one mounting interface 158 recessed therein. At least one aperture 175 can be defined extending at least partially into the second body 115B from the at least one mounting interface 158.

Referring to FIG. 4F, a bottom view a second body 115B with a semi-round, semi-mallet shape can be seen. The rear surface 360 can form a horizontal arc with an apex of the arc extending in a direction opposite. the front face 111. The front face 111 can define a recess 450 in the center between the second toe 141 and the second heel 146. The front face 111 can include rubber sheets 625 disposed thereon. The bottom surface of second sole 155 can have at least one mounting interface 158 recessed therein. At least one aperture 175 can be defined extending at least partially into the second body 115C from the at least one mounting interface 158.

Figures 5A, 5B, 5C:
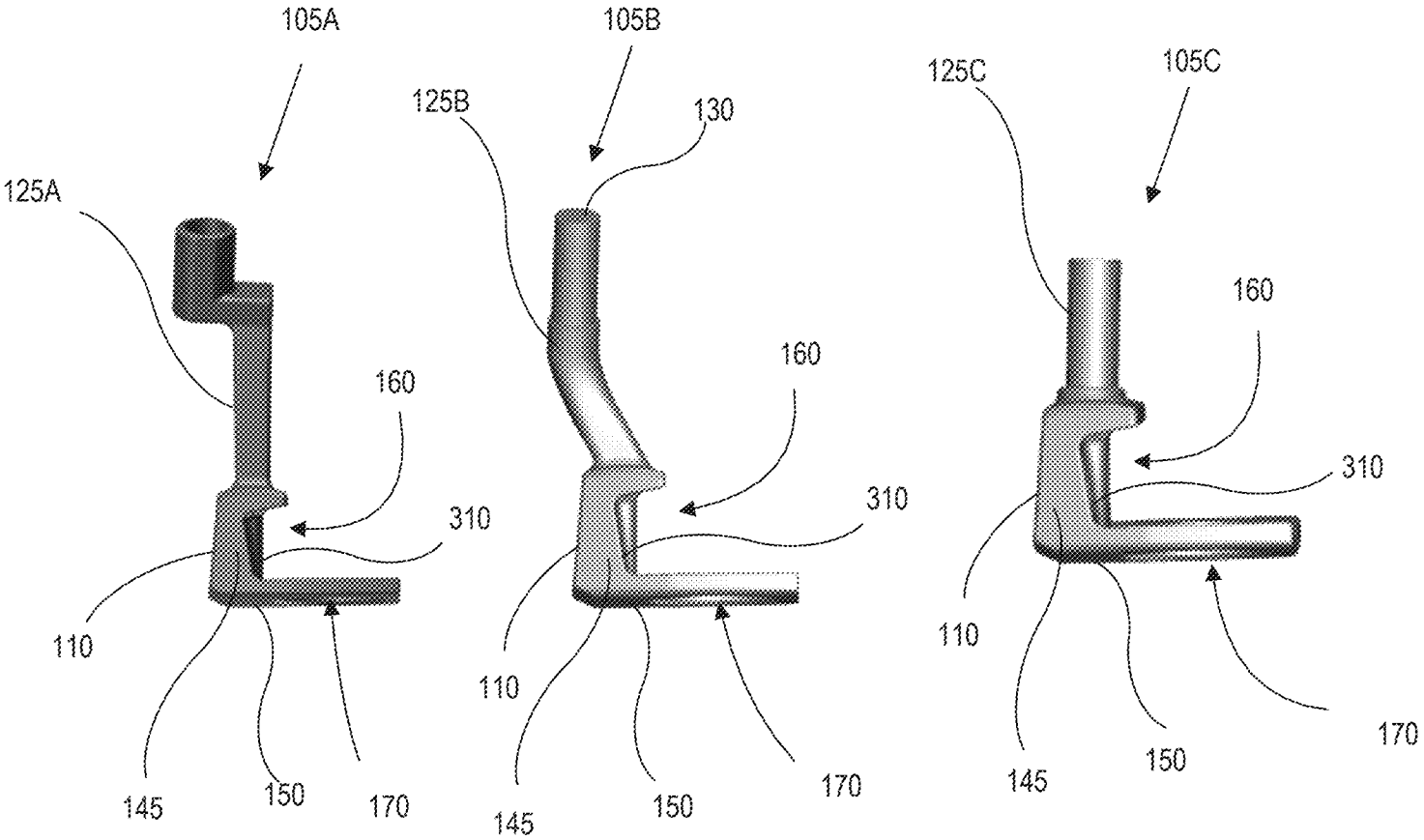
FIG. 5A is a side view of an example body section of a golf club head, according to the disclosed technology.
FIG. 5B is a side view of an example body section of a golf club head, according to the disclosed technology.
FIG. 5C is a side view of an example body section of a golf club head, according to the disclosed technology.

As illustrated in FIGS. 5A-C the first body 105A, 105B, 105C can include a variety of differently shaped hosels 125A, 125B, 125C. As can be appreciated by one in the art, the varying shapes promote different characteristics for the user as well as offer different visual perspectives. In comparison of the three examples shown FIGS. 5A-C, the striking face 110, ledge 127, rear wall 310, first sole, channel 160, and length from the first heel 145 to first toe 140 of the three example bodies remain approximately identical. As can be appreciated by one in the art, by keeping the characteristics of portions of the first body 105 that abut portions of the second body 115 consistent between examples of the disclosed invention, the first bodies 105A, 105B, 105C can each be interchanged and assembled with the same second body 115. As is shown in FIGS. 5A-5C, the characteristics of the hosel 125 can differ to create varying shapes. Referring to FIG. 5A the hosel 125A defines a plumber neck design. Referring to FIG. 5B the hosel 125B defines a slant neck design. Referring to FIG. 5C the hosel 125C defines a spud neck design. As can be appreciated by one in the art, the varying designs can promote differing angles of the golf club head 100 relative to movements of the hosel 125 and the shaft 130.

FIG. 6A shows a perspective view of a first body 105 of a golf club head of the present disclosure. As shown, the first body 105 can include a rear wall 310, a first heel end 145, a first toe end 140, a ledge 127, a hosel 125, a top surface 350 of the first sole 150 defining a shelf, at least one aperture 170 extending through the shelf and the first sole 150, a recess 180, and a channel 160.

Figure 6B:
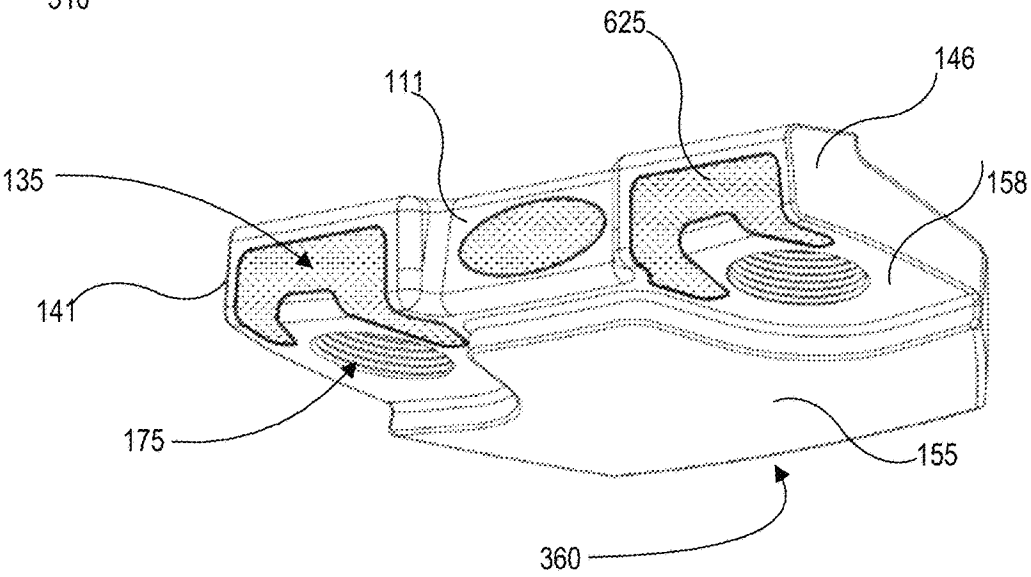
FIG. 6B is a perspective view of an example body section of a golf club head, according to the disclosed technology.

The channel 160 can be formed opposite the striking face 110 such that the channel 160 defines at least three walls. A first wall of the channel 160 can be defined by a bottom side of the ledge 127, a second wall of the channel 160 can be defined by a rear wall 310 substantially opposite the striking face 110, and the third wall of the channel 160 can be defined by a top surface 350 of the first sole 150. The channel 160 can extend from the first toe end 140 to the first heel end 145 and have an opening on each end. As will become apparent throughout this disclosure, the channel 160 can be configured to receive a portion of the second body 115. In this way, the channel 160 can help to hold the second body 115 in place when the golf club head 100 is in an assembled configuration. The rear wall 310 defining the second wall of the channel can include cavities 320 extending inward toward the striking face 110. The cavities can be defined in various shapes, for example ovals, rectangles, triangles, etc. An O-ring 615 or a rubber sheet 625 (such as shown in FIG. 6B) can be disposed within the cavities. The rubber sheet(s) 625 or O-ring(s) 615 can provide for absorption of impact forces between the first body 105 and the second body 115 and help to ensure sufficient frictional forces are present between the first body 105 and the second body 115 to secure the first body 105 to the second body 115.

FIG. 6B shows a perspective view of a second body 115 of a golf club head of the present disclosure. As shown, the second body 115 can include a front surface 111, a second heel end 146, a second toe end 141, a bottom surface of second sole 155 having at least one mounting interface 158 defined therein, and at least one aperture 175 extending at least partially into the second body 115 from the at least one mounting interface 158. The front face 111 of the second body 115 can include cavities 135 extending inward toward the rear surface 360. The cavities can be defined in various shapes, for example ovals, rectangles, triangles, etc. An O-ring 615 (such as shown in FIG. 6A) or a rubber sheet 625 can be disposed within the cavities. The rubber sheet(s) 625 or O-ring(s) 615 can provide for absorption of impact forces between the first body 105 and the second body 115 and help to ensure sufficient frictional forces are present between the first body 105 and the second body 115 to secure the first body 105 to the second body 115.

Figure 7:
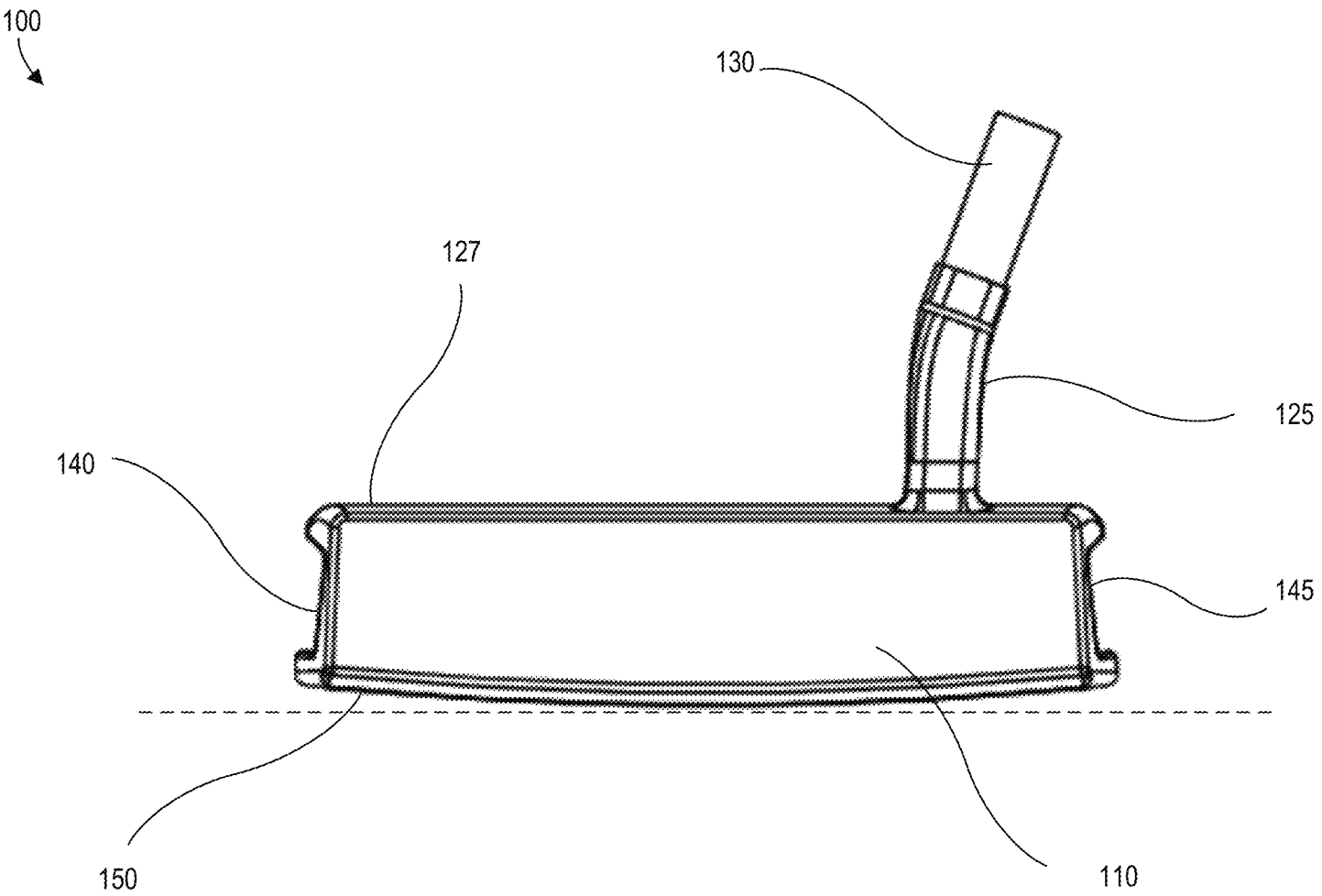
FIG. 7 is a front view of an example body section of a golf club head, according to the disclosed technology.

FIG. 7 shows a front view of a golf club head 100 of the present disclosure. As can be seen in FIG. 7, the striking face 110 can cover the majority of the front of the putter by extending from the first sole 150 to the ledge 127 and from the first toe end 140 to the first heel end 145. The striking face 110, can be substantially flat. The striking face 110 can be formed by a continuous, smooth material. The striking face 110 can include an insert of the same or a different material from the reminder of the striking face 110. The striking face 110 can include etched patterns. A hosel 125 can extend from the ledge 127. As shown, the first sole 150 can be arced or otherwise curved from the first toe end 140 to the first heel end 145 such that if a bottom surface of the first sole 150 rests on a flat surface as depicted by the dashed line, at least a portion of the bottom surface of the first sole 150 would not contact the flat surface.

Figure 8:
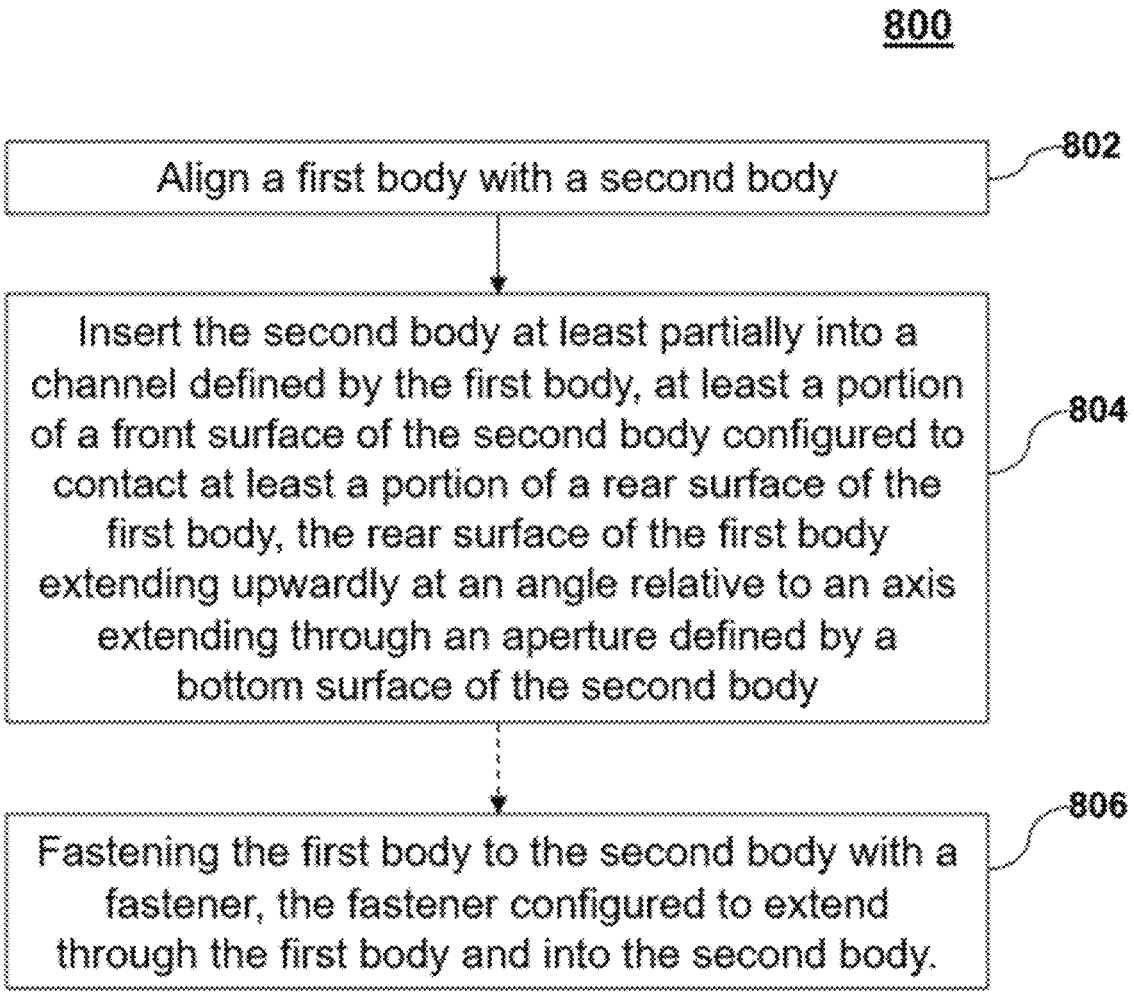
FIG. 8 is a chart of an example method for customizing a golf club head, according to the disclosed technology.

FIG. 8 provides a flowchart of method 800 for manufacturing a modular golf club. Method 800 can include aligning a first body with a second body at step 802. The method 800 can further include inserting the second body at least partially into a channel defined by the first body, at least a portion of a front surface of the second body configured to contact at least a portion of a rear surface of the first body, the rear surface of the first body extends upwardly at an angle relative to an axis extending through an aperture defined by a bottom surface of the second body at step 804. The method can also include fastening the first body to the second body with a fastener, the fastener can extend through the first body and into the second body at step 806.

Aspects of the invention are also provided by the following numbered clauses:

Clause 1: A putter-type golf club head comprising: a first body comprising: a striking face, a first top surface, a first sole, a first heel, a first toe, a first rear wall opposite the striking face, and a hosel, the first body defining at least one first aperture extending through the first body from the first sole; a second body removably attachable to the first body, the second body comprising: a front face, a second top surface, a second sole, a second heel, a second toe, and a second rear surface opposite the front face, the second body defining at least one second aperture extending into the second body, the front face extending upwardly at an angle relative to an axis passing through the at least one second aperture, and a fastener configured to extend through the at least one first aperture and into the at least one second aperture to attach the first body to the second body.

Clause 2: The putter-type golf club head of Clause 1, wherein fastening of the fastener attaches the first body to the second body causing a shear force and a normal force.

Clause 3: The putter-type golf club head of Clause 1, the first body further comprising at least one shelf extending outwardly from the first rear wall, the at least one shelf defining at least a portion of the first sole.

Clause 4: The putter-type golf club head of Clause 1, where at least a portion of the second sole is configured to contact the at least one shelf in an assembled configuration.

Clause 5: The putter-type golf club head of Clause 1, wherein at least a portion of the front face is configured to abut the first rear wall.

Clause 6: The putter-type golf club head of Clause 1, wherein the first sole defines a recess between the first heel and the first toe extending inward toward the first rear wall.

Clause 7: The putter-type golf club head of Clause 6, wherein the second sole comprises a protrusion, wherein the protrusion extends at least partially into the recess when in an assembled configuration.

Clause 8: The putter-type golf club head of Clause 6, wherein the recess has a variable width in a direction between the first heel and the first toe.

Clause 9: The putter-type golf club head of Clause 8, wherein the recess further comprises a first end proximate a rear end of the first sole and a second end proximate the first rear wall opposite the striking face.

Clause 10: The putter-type golf club head of Clause 9, wherein a width of the recess at the first end is greater than a width of the recess at the second end.

Clause 11: The putter-type golf club head of Clause 7, wherein the protrusion further comprises a first end proximate the front face and a second end distal the front face, a width of the protrusion at a first end is greater than a width of the recess at a second end.

Clause 12: The putter-type golf club head of Clause 1, wherein the second body further comprises a pair of wings extending outwardly from the second body opposite the front face.

Clause 13: The putter-type golf club head of Clause 1, wherein the second rear surface of the second body comprises an arc, wherein an apex of the arc extends outwardly from the second body opposite the front face.

Clause 14 The putter-type golf club head of Clause 1, wherein the second rear surface extends along a plane that is parallel to the front face.

Clause 15: The putter-type golf club head of Clause 1, wherein the hosel comprises a slant neck.

Clause 16: The putter-type golf club head of Clause 1, wherein the hosel comprises a spud neck.

Clause 17: The putter-type golf club head of Clause 1, wherein the hosel comprises a plumber neck.

Clause 18: The putter-type golf club head of Clause 1, wherein the putter-type golf club head is configured to form a mallet shape when in an assembled configuration.

Clause 19: The putter-type golf club head of Clause 1, wherein the putter-type golf club head is configured to form a semi-mallet shape when in an assembled configuration.

Clause 20: The putter-type golf club head of Clause 1, wherein the putter-type golf club head is configured to form a blade shape when in an assembled configuration.

Clause 21: The putter-type golf club head of Clause 1, wherein the fastener comprises a weight between 2 and 50 grams.

Clause 22: The putter-type golf club head of Clause 1, further comprising a rubber sheet disposed between the first rear wall opposite the striking face and the front face.

Clause 23: The putter-type golf club head of Clause 1, further comprising at least one o-ring disposed between the first rear wall opposite the striking face and the front face.

Clause 24: The putter-type golf club head of Clause 1, wherein the second body is hollow.

Clause 25: The putter-type golf club head of Clause 1, wherein the rear surface opposite the striking face defines a first cavity.

Clause 26: The putter-type golf club head of Clause 25, further comprising a rubber sheet disposed within the first cavity.

Clause 27: The putter-type golf club head of Clause 25, further comprising an o-ring disposed within the first cavity.

Clause 28: A putter head comprising: a first body comprising: a striking face; a rear wall opposite the striking face extending at an angle relative to a plane along the striking face; a ledge extending rearwardly from a top end of the body, a bottom side of the ledge at least partially abutting the rear wall; a first heel; a first toe; a first sole; a top side of the first sole partially abutting the rear wall opposite the striking face; and a hosel extending outwardly from the ledge; a second body removably attachable to the first body, the second body comprising: a second sole; a top side of the second sole; a second heel; a second toe; a front face; and at least one mounting interface formed into the second sole, the at least one mounting interface configured to contact at least a portion of the top side of the first sole; and a fastener configured to attach the first body to the second body.

Clause 29: The putter-type golf club head of Clause 28, wherein the bottom side of the ledge extends outwardly from the first body at an angle relative to a plane normal to the striking face.

Clause 30: The putter-type golf club head of Clause 28, wherein the first body further comprises a variable cross-sectional thickness between the striking face and the rear wall opposite the striking face.

Clause 31: A putter head of Clause 30, wherein the cross-sectional thickness between the striking face and the rear wall increases from the bottom side of the ledge to the top side of the first sole.

Clause 32: A putter head of Clause 28, the rear wall comprising a protruding section extending outwardly in a direction opposite the striking face.

Clause 33: A putter head of Clause 32, the front face defining a recess section, the protruding section being configured to extend at least partially into the recess section.

Clause 34: A putter head of Clause 28, wherein the first sole of the first body defines a recess between the first heel and the first toe extending inwardly from a rear of the first sole toward the rear wall, wherein the recess comprises a variable width in a direction between the first heel and the first toe, the width increases as the recess extends inward to the rear wall opposite the striking face.

Clause 35: The putter head of Clause 34, wherein two mounting interfaces are formed into the second sole defining a protruding section of the second sole between the two mounting interfaces, wherein the protruding section is configured to extend into the recess when in an assembled configuration.

Clause 36: A putter head comprising: a first body comprising: a striking section, the striking section comprising a striking face and a rear face, the rear face defining a channel; a first sole disposed at a bottom of the striking section, the first sole defining at least one aperture that extends through the first sole; a neck extending from a top face of the striking section; a second body, configured to be attached to the first body, the second body comprising: a second sole section; a top side of the second sole section; and a front section attached to the second sole section and defining at least one recess, wherein the front section is configured to contact the channel and the at least one recess of the front section is configured to align with the at least one aperture of the first sole; and a fastener configured to extend through the at least one aperture and into the at least one recess to attach the first body to the second body.

Clause 37: The putter head of Clause 36, wherein the channel further comprises a wall opposite the striking face, a top wall at a first end of the wall opposite the striking face, and a bottom wall at a second end of the wall opposite the striking face.

Clause 38: The putter head of Clause 37, wherein a top side of the first sole extends from the bottom wall of the channel.

Clause 39: The putter head of Clause 36 wherein fastening of the fastener applies a shear force and a normal force between the first body and the second body.

Clause 40: A method of customizing a putter head, the method comprising: aligning a first body with a second body; inserting the second body at least partially into a channel defined by the first body, at least a portion of a front surface of the second body configured to contact at least a portion of a rear surface of the first body, the rear surface of the first body extends upwardly at an angle relative to an axis extending through an aperture defined by a bottom surface of the second body; and fastening the first body to the second body with a faster, the fastener configured to extend through the first body and into the second body.

Clause 41: The method of Clause 40, further comprising inserting a third body upon the second body.

Clause 42: The method of Clause 40, wherein the second body is selected from among a plurality of second bodies, each second body of the plurality of second bodies being different from another second body of the plurality of second bodies.

Clause 43: The putter-type golf club head of Clause 1, wherein the fastener comprises a weight between 5 g to 40 g.

Clause 44: The putter-type golf club head of Clause 1, wherein the fastener comprises a diameter between 0.2 inches and 3.5 inches.

Clause 45: The putter-type golf club head of Clause 44, wherein the fastener comprises shelf extending radially from the fastener, the shelf comprising a diameter between 0.25 inches and 3.5 inches.

Clause 46: The putter-type golf club head of Clause 1, wherein the fastener comprises a height between 0.1 inches to 3 inches.

Clause 47: The putter-type golf club head of Clause 1, the angle relative to an axis passing through the at least one second aperture is between 2 and 45 degrees.

Clause 48: The putter-type golf club head of Clause 1, the angle relative to an axis passing through the at least one second aperture is between 2 and 20 degrees.

Clause 49: The putter-type golf club head of Clause 1, the angle relative to an axis passing through the at least one second aperture is between 2 and 10 degrees.

It is to be understood that the mention of one or more method steps does not preclude the presence of additional method steps or intervening method steps between those steps expressly identified. It is also to be understood that the examples and claims disclosed herein are not limited in their application to the details of construction and arrangement of the components set forth in the description and illustrated in the drawings. Rather, the description and the drawings provide examples of the disclosed technology envisioned. The examples and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the disclosed technology and claims presented in this application. It is important, therefore, that the claims be regarded as including such equivalent constructions.

What is claimed is:

1. A putter-type golf club head comprising:

a first body comprising:

a striking face, a first top surface, a first sole, a first heel, a first toe, a first rear wall opposite the striking face, and a hosel, the first body defining at least one first aperture extending through the first body from the first sole;

a second body removably attachable to the first body, the second body comprising:

a front face, a second top surface, a second sole, a second heel, a second toe, and a second rear surface opposite the front face, the second body defining at least one second aperture extending into the second body, the front face extending at an angle relative to an axis passing through the at least one second aperture such that a distance between the front face and the axis is greater near the second top surface than a distance between the front face and the axis near the second sole; and a fastener configured to extend through the at least one first aperture and into the at least one second aperture to attach the first body to the second body.

2. The putter-type golf club head of claim 1, wherein fastening of the fastener attaches the first body to the second body causing a shear force and a normal force.

3. The putter-type golf club head of claim 1, the first body further comprising at least one shelf extending outwardly from the first rear wall, the at least one shelf defining at least a portion of the first sole.

4. The putter-type golf club head of claim 3, where at least a portion of the second sole is configured to contact the at least one shelf in an assembled configuration.

5. The putter-type golf club head of claim 1, wherein at least a portion of the front face is configured to abut the first rear wall.

6. The putter-type golf club head of claim 1, wherein the first sole defines a recess between the first heel and the first toe extending inward toward the first rear wall.

7. The putter-type golf club head of claim 6, wherein the second sole comprises a protrusion, wherein the protrusion is configured to extend at least partially into the recess.

8. The putter-type golf club head of claim 7, wherein the protrusion further comprises a first end proximate the front face and a second end distal the front face, a width of the protrusion at the first end is less than a width of the recess at the second end.

9. The putter-type golf club head of claim 6, wherein the recess has a variable width in a direction between the first heel and the first toe.

10. The putter-type golf club head of claim 9, wherein the recess further comprises a first end proximate a rear end of the first sole and a second end proximate the first rear wall opposite the striking face.

11. The putter-type golf club head of claim 10, wherein a width of the recess at the first end is greater than a width of the recess at the second end.

12. The putter-type golf club head of claim 1, wherein the fastener comprises a weight between 2 and 50 grams.

13. The putter-type golf club head of claim 1, further comprising a rubber sheet disposed between the first rear wall opposite the striking face and the front face.

14. The putter-type golf club head of claim 1, wherein the rear wall opposite the striking face defines a first cavity.

15. A putter head comprising:

a first body comprising:

a striking section, the striking section comprising a striking face and a rear face, the rear face defining a channel;

a first sole disposed at a bottom of the striking section, the first sole defining at least one aperture that extends through the first sole;

a neck extending from a top face of the striking section;

a second body, configured to be attached to the first body, the second body comprising:

a second sole section;

a top side of the second sole section; and a front section attached to the second sole section and defining at least one recess, wherein the front section is configured to extend at least partially into the channel and the at least one recess of the front section is configured to align with the at least one aperture of the first sole; and a fastener configured to extend through the at least one aperture and into the at least one recess to attach the first body to the second body.

16. The putter head of claim 15, wherein the channel further comprises a wall opposite the striking face, a top wall at a first end of the wall opposite the striking face, and a bottom wall at a second end of the wall opposite the striking face.

17. The putter head of claim 16, wherein a top side of the first sole extends from the bottom wall of the channel.

18. The putter head of claim 15, wherein fastening of the fastener applies a shear force and a normal force between the first body and the second body.

19. A putter head comprising:

a first body comprising:

a striking face;

a rear wall opposite the striking face;

a ledge extending rearwardly from a top end of the first body when the putter head is in an address position, a bottom side of the ledge at least partially abutting the rear wall;

a first heel;

a first toe;

a first sole;

a top side of the first sole partially abutting the rear wall opposite the striking face; and a hosel extending outwardly from the ledge;

a second body removably attachable to the first body, the second body comprising:

a second sole;

a top side of the second sole;

a second heel;

a second toe;

a front face; and at least one mounting interface formed into the second sole, the at least one mounting interface configured to contact at least a portion of the bottom side of the ledge; and a fastener configured to attach the first body to the second body.

20. The putter head of claim 19, wherein the first body further comprises a variable cross-sectional thickness between the striking face and the rear wall opposite the striking face from the ledge to the first sole.

* * * * *